US010345053B2

(12) United States Patent
Amaya et al.

(10) Patent No.: US 10,345,053 B2
(45) Date of Patent: Jul. 9, 2019

(54) HEAT EXCHANGER, SUCH AS A CHARGE AIR COOLER

(71) Applicant: TITANX Holding AB, Solvesborg (SE)

(72) Inventors: Luis Amaya, Solvesborg (SE); Bengt-Ove Birgersson, Solvesborg (SE); Anders Noren, Kristanstad (SE)

(73) Assignee: TITANX HOLDING AB, Solvesborg (SE)

( * ) Notice: Subject to any disclaimer, the term of this patent is extended or adjusted under 35 U.S.C. 154(b) by 586 days.

(21) Appl. No.: 15/138,817

(22) Filed: Apr. 26, 2016

(65) Prior Publication Data

US 2016/0238328 A1 Aug. 18, 2016

Related U.S. Application Data

(62) Division of application No. 12/735,982, filed as application No. PCT/SE2009/000130 on Mar. 11, 2009, now abandoned.

(30) Foreign Application Priority Data

Mar. 28, 2008 (SE) ..... 0800689

(51) Int. Cl.
*F28F 13/12* (2006.01)
*F28F 3/02* (2006.01)
(Continued)

(52) U.S. Cl.
CPC ..... *F28F 13/12* (2013.01); *F28D 7/0041* (2013.01); *F28D 7/1684* (2013.01); *F28F 1/128* (2013.01);
(Continued)

(58) Field of Classification Search
CPC .... F28F 1/126; F28F 1/105; F28F 1/32; F28F 1/325; F28F 1/20; F28F 1/22; F28F 3/027;
(Continued)

(56) References Cited

U.S. PATENT DOCUMENTS 5,441,106 A * 8/1995 Yukitake ..... F28D 1/0391 165/177
6,340,053 B1 * 1/2002 Wu ..... F28D 9/0012 165/140
(Continued)

FOREIGN PATENT DOCUMENTS

EP 1 707 911 A1 10/2006
EP 1707911 A1 * 10/2006 ..... F02B 29/0462
(Continued)

OTHER PUBLICATIONS

EP1707911—Machine Translation.*
(Continued)

*Primary Examiner* — Devon Russell
(74) *Attorney, Agent, or Firm* — Harness, Dickey & Pierce, P.L.C.

(57) ABSTRACT

A heat exchanger, such as a water cooled charge air cooler, is disclosed for cooling of charge air with the aid of coolant. In at least one embodiment, the heat exchanger includes charge air tubes and coolant turbulators made of corrugated sheet metal interposed between the air tubes. The turbulators define coolant channels and including at least one turbulating device provided therein. According to at least one embodiment of the invention, at least one channel includes at least one continuously shaped side wall which is non-apertured along its entire length and thus promotes coolant flow along the channel by inhibiting cross flow of coolant to a neighbouring channel.

3 Claims, 3 Drawing Sheets

(51) Int. Cl.

| | |
|---|---|
| ***F28D 7/00*** | (2006.01) |
| ***F28D 7/16*** | (2006.01) |
| ***F28F 1/12*** | (2006.01) |
| *F28D 21/00* | (2006.01) |
| *F28F 3/04* | (2006.01) |
| *F28F 21/08* | (2006.01) |

(52) U.S. Cl.
CPC ..... *F28F 3/027* (2013.01); *F28D 2021/0082* (2013.01); *F28F 3/044* (2013.01); *F28F 21/084* (2013.01); *F28F 2210/08* (2013.01); *F28F 2275/04* (2013.01)

(58) Field of Classification Search
CPC . F28F 13/12; F28F 3/046; F28F 3/025; F28D 2021/0082
USPC ..... 62/398, 400
See application file for complete search history.

(56) References Cited

U.S. PATENT DOCUMENTS 6,962,194 B2 * 11/2005 Martin ..... B23K 1/0012 165/170
7,025,127 B2 * 4/2006 Wu ..... F28D 1/0308 165/168
7,182,125 B2 * 2/2007 Martin ..... F28D 1/0383 165/109.1
7,219,720 B2 * 5/2007 Wakita ..... B23P 15/26 165/153
8,261,816 B2 9/2012 Ambros et al.
2002/0174979 A1 11/2002 Haegele et al.
2003/0164233 A1 * 9/2003 Wu ..... F28D 1/0308 165/166
2005/0161206 A1 7/2005 Ambros et al.
2006/0196632 A1 * 9/2006 Kudo ..... F28D 20/02 165/10
2006/0283585 A1 * 12/2006 Smith ..... F28F 3/025 165/177
2007/0012430 A1 * 1/2007 Duke ..... F28F 1/128 165/109.1
2007/0056720 A1 * 3/2007 Demuth ..... F28D 7/1692 165/158

FOREIGN PATENT DOCUMENTS

| | | | |
|---|---|---|---|
| JP | 2002-327996 | A | 11/2002 |
| JP | 2004-047260 | A | 2/2004 |
| JP | 2007-051804 | A | 3/2007 |
| SE | 529 134 | C2 | 5/2007 |

OTHER PUBLICATIONS

Machine Translation of EP1707911, 4 pages.
International Search Report (PCT/ISA /210) for International Application No. PCT/SE2009/000130 dated Jun. 25, 2009.

* cited by examiner

Fig. 1
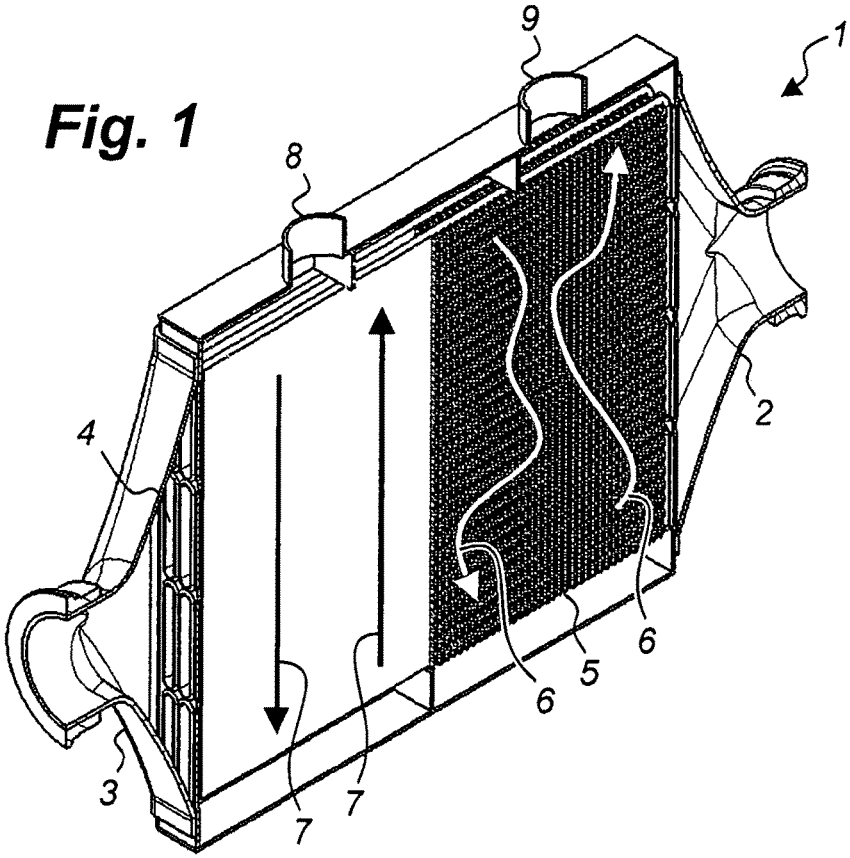
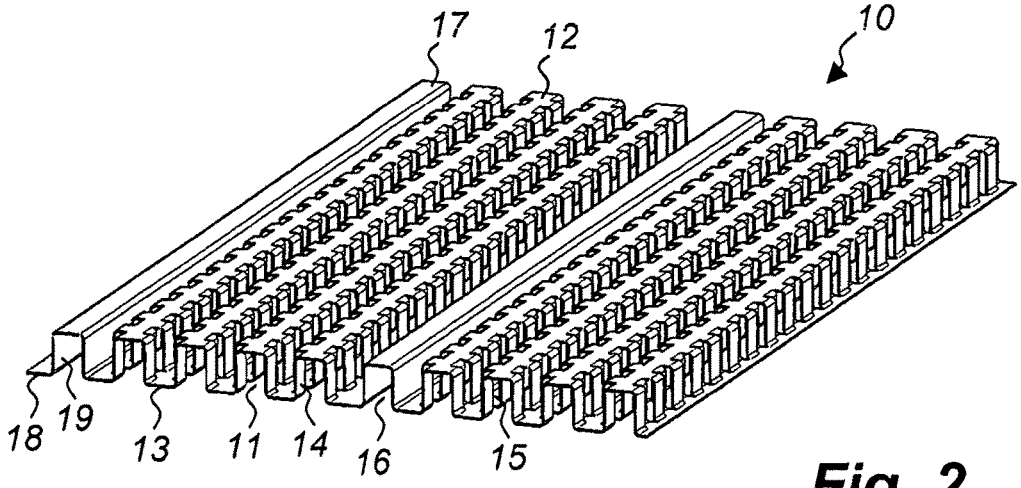
Fig. 2

HEAT EXCHANGER, SUCH AS A CHARGE AIR COOLER

CROSS-REFERENCE TO RELATED APPLICATIONS

This patent application is a divisional of and claims priority under 35 U.S.S. §§ 120/121 to U.S patent application No. U.S application Ser. No. 12/735,982 filed Aug. 30, 2010, which is a national phase under 35 U.S. C. § 371 of PCT International Application No. PCT/SE2009/000130 which has an International filing date of Mar. 11,2009, which claims priority to Swedish Patent Application No. 0800689-2 filed Mar. 28. 2008, the entire contents of each of which are incorporated herein by reference.

TECHNICAL FIELD

The present invention concerns a heat exchanger, such as a water cooled charge air cooler (WCCAC), for cooling of charge air with the aid of coolant, said heat exchanger comprising charge air tubes and coolant turbulators made of corrugated sheet metal interposed between the tubes, the turbulators defining coolant channels and having turbulating means provided therein.

PRIOR ART

A heat exchanger according to the preamble is known from the European patent application EP 1 707 911 A1. According to an embodiment shown and described in this document, the coolant turbulators are made of corrugated sheet metal, the corrugations defining flat bottom and top walls connected to almost vertical side walls with a sharp angle. The side walls as seen from above show an offset pattern with alternating straight side wall parts jumping from left to right and back again in a mathematically speaking non-continuous way, thus creating side walls with a broken outline. Between said side wall parts there are apertures, through which coolant can flow from one coolant channel to another, thus allowing a certain cross flow. The cross flow causes losses in coolant heat exchange because the coolant is not following all the length of the turbulator.

In an embodiment not shown but described in said document the apertures between the offset side wall parts are closed thus forming closed channels. It is obvious that this stops cross flow from one closed channel to another, thus in theory improving the situation. However, it shows that the non-continuous side walls of the closed channels with their sharp broken outlines lead to high friction and thus to an increase in coolant restriction inside the closed channels. Therefore no real benefit is achieved compared to the embodiment with apertures in the channel side walls.

OBJECT OF THE INVENTION

Against that background the object of the inventions is to improve a heat exchanger according to the preamble by eliminating the drawbacks of the prior art, especially when it comes to pressure drop, and yet providing enough turbulence for an optimum heat exchange between the coolant and the air inside the charge air tubes.

SHORT SUMMARY OF THE INVENTION

This object is achieved by at least one channel having at least one continuously shaped side wall which are non-apertured along its entire length and thus promotes coolant flow along said channel by inhibiting cross flow of coolant to a neighbouring channel. Contrary to the prior art solution, where all the channels of the corrugated turbulators have side walls, which are designed to create turbulence, according to the invention there is at least one channel side wall designed to promote coolant flow, which lowers pressure drop in a notable way without endangering the cooling efficiency of the heat exchanger.

According to one embodiment of the invention at least three channels are closed channels, which on both sides have such continuously side walls and are regularly spaced across the turbulator. It is obvious that a single closed channel in between a great number of apertured, turbulence promoting channels only has a minor effect on pressure drop and that an increased number of closed channels can remedy that.

According to another embodiment of the invention at least every tenth channel is a closed channel, which on both sides has such continuously shaped side walls. In most heat exchangers it turns out that the best results, i.e. a good compromise between cooling efficiency and pressure drop, are achieved if closed channels are spaced not further apart than that.

According to yet another embodiment of the invention all channels are closed channels, which on both sides have continuously shaped side walls, which are non-apertured, and top and bottom walls, which have turbulence creating inverted dimples protruding into the channels along the entire length of these with a certain spacing. In this embodiment of the invention all channels of the turbulators are closed, coolant flow promoting ones, which results in a very low pressure drop but also in a deteriorated cooling efficiency. This is remedied in a surprisingly simple way by means of said inverted dimples, which create turbulence with less flow resistance than the apertured or non-apertured side walls of the prior art heat exchanger.

Preferably, in the latter embodiment of the invention the closed channels are meander shaped due to smoothly winding side walls. The chosen meander shape further enhances turbulence and yet it does not substantially increase flow resistance.

Further, in a preferred embodiment of the latter embodiment an inverted dimple is provided on the top and bottom walls at each meander turn of the closed channels. A channel design of this kind turns out to be a good compromise between cooling efficiency and pressure drop.

According to a preferred all the channels have a first continuously shaped side wall, which is non-apertured, and a second opposing side wall, which is provided with turbulence creating apertures. Obviously this solution confines coolant flow without putting up to much resistance, and yet it creates enough turbulence to achieve a high heat exchange efficiency.

Preferably, in the preferred embodiment of the heat exchanger the turbulence creating apertures form interruptions in top and bottom walls of the channels as well. Again this is advantageous to heat exchange efficiency.

BRIEF DESCRIPTION OF THE DRAWINGS

The invention is described in detail in below with reference to the schematic drawings.

In the drawings:

FIG. 1 is an isometric view of a heat exchanger with parts thereof broken away for clarity;

FIG. 2 is an isometric view of a turbulator for a first embodiment of the invention;

DESCRIPTION OF TWO EMBODIMENTS

Figure 3:
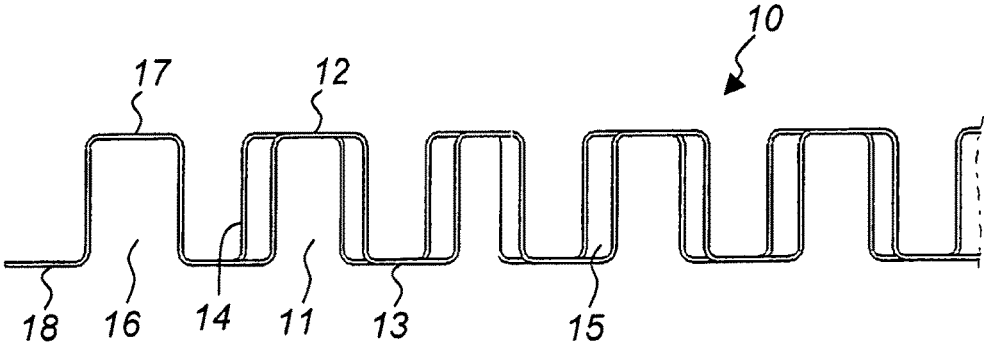
FIG. 3 is a partial cross section view of the turbulator in FIG. 2.

The heat exchanger 1 of FIG. 1 is a so called WCCAC (Water Cooled Charge Air Cooler) provided for cooling of charge air to an internal combustion engine (not shown) by means of a coolant, mainly comprising water. The coolant is circulated by a pump of said engine and dissipates accumulated heat through a radiator, which also provides cooling for said engine.

The charge air is led into and out of the heat exchanger 1 by means of two opposing cowlings 2, 3, and inside of the heat exchanger 1 the charge air flows through air tubes 4. The air tubes 4 are of a flat design and extend in parallel through said heat exchanger 1 in four groups of five air tubes 4 each. In each group flat sides of the air tubes 4 in the group face each other or casing walls of the heat exchanger 1. Across the flat sides of the air tubes 4 and brazed thereto there are a plurality of coolant turbulators 5. These are preferably made of aluminium sheet metal. As indicated by means of four arrows 6, 7, the coolant turbulators define an altogether serpentine flow path through the heat exchanger from a coolant inlet 8 to a coolant outlet 9. They do it by being corrugated, the corrugation ridges and valley extending transversely of the air tubes 4, and have a design described in detail below.

In FIGS. 2 and 3 parts of a turbulator 10 for a first embodiment of a heat exchanger 1 according to the invention is shown. The turbulator 10 is made of a aluminium sheet which has been stamped into a corrugated pattern which comprises two different kinds of channels.

The first kind is designated 11 and has flat top and bottom walls 12, 13 and vertical side walls 14. The side walls 14 have turbulence creating apertures 15 therein, made by offset stamping/cutting in a known way and resulting in a non-continuous side wall shape. The apertures 15 allow cross flow of coolant between the channels 11 and would, if all channels across the turbulator 10 were of that kind, result in a coolant flow pattern exemplified by the arrows 6 in FIG. 1. Such a flow pattern causes cross flow, which is detrimental to efficiency.

In order to remedy this, amongst the first kind of apertured channels 11 are arranged a second kind of channels, which are designated 16. The channels 16 too have flat top and bottom walls 17, 18 and vertical side walls 19. However, these side walls 19 are continuously shaped ones, which are all straight and lack apertures. In that way they hinder cross flow of coolant to neighbouring channels 11 and confine coolant flow through the heat exchanger 1 to narrower, more straight-lined flow paths as illustrated by the arrows 7 in FIG. 1.

It is obvious that the second kind of closed channels 16 do not transfer heat as effectively as the first kind of open channels 11. Thus, it is preferred to arrange less closed channels 16 than open channels 11. Should the heat exchanger 1 be a narrow one, one closed channel 16 amongst a plurality of open channels 11 could well suffice. However, a wider heat exchanger 1 requires more closed channels 16 than that to straighten the coolant flow through the heat exchanger. Hence, in a wider heat exchanger several closed channels 16, each surrounded by open ones, are recommended, preferably with a regular spacing, such as one at least every tenth channel.

Figure 4:
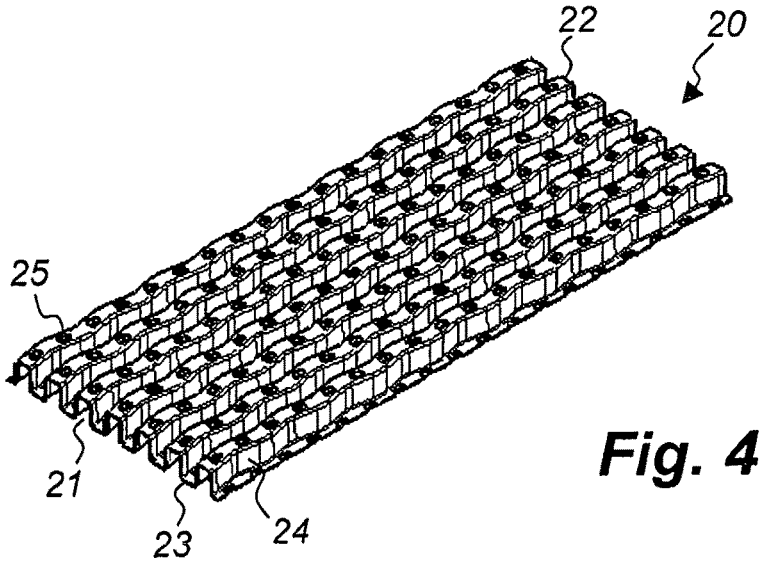
FIG. 4 is an isometric view of a turbulator for a second embodiment of the invention.
Figure 5:
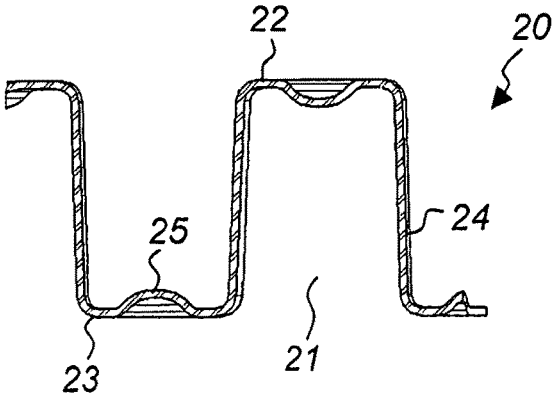
FIG. 5 is a partial cross section view of the turbulator in FIG. 4.

In FIGS. 4 and 5 parts of a turbulator 20 for a second embodiment of a heat exchanger 1 according to the invention is shown. The turbulator 20 too is made of a aluminium sheet which has been stamped into a corrugated pattern, but it comprises but kind of channels.

These channels are designated 21 and have flat top and bottom walls 22, 23 and vertical side walls 24. The side walls 24 are parallel to each other and follow a meander shaped outline, causing some degree of turbulence when coolant passes there through although there are no apertures at all in the side walls 24. The turbulence is further enhanced by means of inverted dimples 25, which are stamped into the aluminium sheet and protrude into the channels 21 along the entire length of these with a certain spacing. Preferably as shown in the drawings the spacing is such, that there is one inverted dimple 25 at each meander turn of a channel 21.

It is obvious that a heat exchanger 1 according to the second embodiment with turbulators 20 only having wavy, closed channels 21 gives rise to an even lower flow resistance than the heat exchanger 1 according to the first embodiment, because it inhibits coolant cross flow even more. However, without the extra turbulence created by the inverted dimples 25 and relying only on the turbulence created by means of the non-apertured, continuous meander shaped side walls 24 alone, one has to upgrade size of the heat exchanger 1 in order to achieve a comparable cooling effect.

Figure 6:
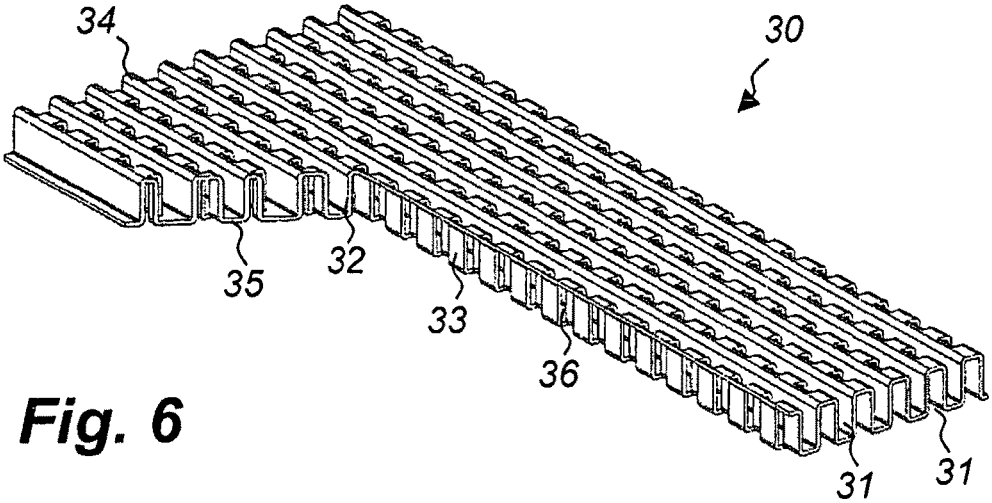
FIG. 6 is an isometric view of a third and preferred embodiment of the invention.
Figure 7:
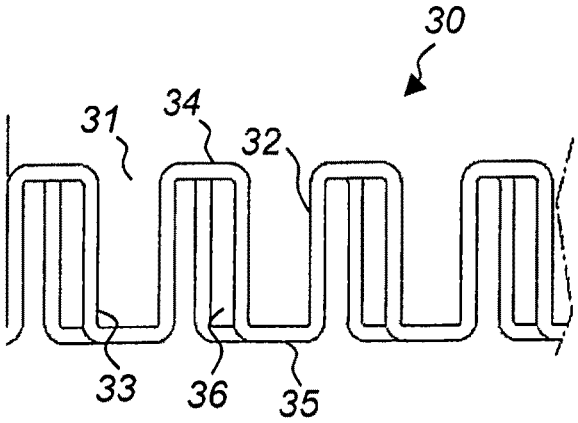
FIG. 7 is a partial cross section view of the turbulator in FIG. 6.

In FIGS. 6 and 7 parts of a turbulator 30 for a third embodiment of a heat exchanger 1 according to the invention is shown. The turbulator 30 too is made of a aluminium sheet which has been stamped into a corrugated pattern, and like the second embodiment it comprises but one kind of channels.

These channels designated are 31 and comprise vertical side walls 32, 33 and top and bottom walls 34, 35. The side walls 32, 33 are parallel to each other, but are of two different kinds. Thus, the first kind of side walls 32 resemble the closed ones 19 of the first embodiment of the invention, whereas the second kind of side walls 33 resemble the apertured ones 14 of the first embodiment of the invention. This leads to channels 31 promoting both coolant flow by means of the first kind side walls 32, which are non-apertured and smooth, and heat exchange by means of the second kind of side walls 33 with apertures 36 therein.

Preferably, in the third embodiment said apertures 36 form interruptions in the top and bottom walls 34, 35 of the channels 31 as well. This is highly beneficial when it comes to production by stamping and differs from previous solutions, where both channel side walls used to be apertured.

It is apparent, that the embodiments described can be combined in different ways within the scope of the invention.

The invention claimed is:

1. Heat exchanger for cooling of charge air with the aid of coolant, said heat exchanger comprising:

charge air tubes; and coolant turbulators made of corrugated sheet metal interposed between said air tubes, the turbulators defining coolant channels and including turbulating devices provided therein, at least one of the coolant channels including at least one continuously shaped side wall which is non-apertured along its entire length and thus promotes coolant flow along said at least one channel by inhibiting cross flow of coolant to a neighbouring one of the coolant channels, wherein all the coolant channels include a first continuously shaped side wall, which is non-apertured, and a second opposing side wall, which is provided with turbulence creating apertures, and wherein a width of the channels is defined by the first continuously shaped side wall and an adjacent second opposing side wall.

2. Heat exchanger according to claim 1, wherein the turbulence creating apertures form interruptions in top and bottom walls of the channels.

3. Heat exchanger according to claim 1, wherein the heat exchanger is a water cooled charge air cooler for cooling of charge air.

* * * * *